US010212510B2

(12) United States Patent
Han et al.

(10) Patent No.: US 10,212,510 B2
(45) Date of Patent: Feb. 19, 2019

(54) LOUDSPEAKER MODULE

(71) Applicant: GOERTEK INC., Weifang (CN)

(72) Inventors: Dan Han, Weifang (CN); Yun Yang, Weifang (CN); Xinxiang Huo, Weifang (CN); Xudong Liu, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/564,646

(22) PCT Filed: Dec. 18, 2015

(86) PCT No.: PCT/CN2015/097965
§ 371 (c)(1),
(2) Date: Oct. 5, 2017

(87) PCT Pub. No.: WO2016/173276
PCT Pub. Date: Nov. 3, 2016

(65) Prior Publication Data

US 2018/0070168 A1 Mar. 8, 2018

(30) Foreign Application Priority Data

Apr. 30, 2015 (CN) ..... 2015 1 0218915

(51) Int. Cl.
*H04R 1/28* (2006.01)
*H04R 1/02* (2006.01)
(Continued)

(52) U.S. Cl.
CPC ..... *H04R 1/2842* (2013.01); *H04R 1/025* (2013.01); *H04R 1/2803* (2013.01);
(Continued)

(58) Field of Classification Search
CPC ..... H04R 1/025; H04R 1/026; H04R 1/2811; H04R 1/2842; H04R 1/2849;
(Continued)

(56) References Cited

U.S. PATENT DOCUMENTS 8,903,117 B1 12/2014 Dai et al.
2013/0156237 A1* 6/2013 Kim ..... H04R 9/06 381/191

FOREIGN PATENT DOCUMENTS

CN 201699964 U 1/2011
CN 201750544 U 2/2011
(Continued)

OTHER PUBLICATIONS

International Search Report dated Feb. 23, 2016 for PCT Application No. PCT/CN2015/097965.
(Continued)

*Primary Examiner* — Joshua Kaufman
(74) *Attorney, Agent, or Firm* — Moser Taboada

(57) ABSTRACT

Disclosed is a loudspeaker module, comprising a shell, wherein a vibrating system and a magnetic circuit system are accommodated in the shell, the vibrating system comprises a vibrating diaphragm and a voice coil which are combined together; a whole inner cavity of the module is divided by the vibrating diaphragm into two cavities, i.e. a front voice cavity and a rear voice cavity; an edge portion of the vibrating diaphragm is fixed on the shell by using an annular supporting member, a plurality of cavity expansion portions formed by incomplete filling are distributed on the supporting member at intervals, and each of the cavity expansion portions is communicated with the rear voice cavity. The loudspeaker module of the present disclosure solves the technical problem of F0 rising due to the narrow rear voice cavity of the loudspeaker module in the prior art.

9 Claims, 2 Drawing Sheets

(51) Int. Cl.

| | |
|---|---|
| ***H04R 9/06*** | (2006.01) |
| ***H04R 31/00*** | (2006.01) |
| *H04R 9/02* | (2006.01) |
| *H04R 7/12* | (2006.01) |

(52) U.S. Cl.
CPC ..... *H04R 1/2811* (2013.01); *H04R 9/06* (2013.01); *H04R 31/006* (2013.01); *H04R 1/2857* (2013.01); *H04R 7/127* (2013.01); *H04R 9/025* (2013.01); *H04R 2499/11* (2013.01)

(58) Field of Classification Search
CPC .... H04R 1/2892; H04R 1/2896; H04R 9/025; H04R 9/06; H04R 31/006; H04R 2499/11
See application file for complete search history.

(56) References Cited

FOREIGN PATENT DOCUMENTS

| | | | |
|---|---|---|---|
| CN | 102065357 | A | 5/2011 |
| CN | 202841513 | U | 3/2013 |
| CN | 103118320 | A | 5/2013 |
| CN | 204069321 | U | 12/2014 |
| CN | 104811857 | A | 7/2015 |
| CN | 204598281 | U | 8/2015 |

OTHER PUBLICATIONS

Chinese Office Action dated Jul. 3, 2017 for Application No. 201510218915.4.

* cited by examiner

LOUDSPEAKER MODULE

CROSS REFERENCE TO RELATED APPLICATIONS

This application is a National Stage entry of International Application No. PCT/CN2015/097965, filed on Dec. 18, 2015, which claims priority to Chinese Patent Application No. 201510218915.4, filed on Apr. 30, 2015. The disclosure of the priority applications are hereby incorporated in their entirety by reference.

TECHNICAL FIELD

The present disclosure relates to the technical field of electroacoustic products, and in particular, to a loudspeaker module.

BACKGROUND

Loudspeaker modules are important acoustic component of portable electronic devices, for completing the conversion between an electric signal and an acoustic signal, and are energy conversion devices. The existing loudspeaker modules usually comprise a shell, wherein the shell accommodates a vibrating system and a magnetic circuit system. The vibrating system comprises a vibrating diaphragm and a voice coil which are combined together. A whole inner cavity of the module is divided by the vibrating diaphragm into two cavities, i.e. a front voice cavity and a rear voice cavity. F0 (resonant frequency) is an important index of loudspeaker modules, and as its value decreases, a loudspeaker module has a wider frequency band and a better acoustic performance. F0 is mainly influenced by the volume of the rear voice cavity and the compliance of the vibrating diaphragm in the module, i.e., the value of F0 is smaller as the volume of the rear voice cavity or the compliance of the vibrating diaphragm increases.

However, since portable electronic devices continuously become thinner, lighter and compacter, loudspeaker modules are also increasingly thinner and smaller, and thus the volume of the rear voice cavity is continuously decreased. As the volume of the rear voice cavity of loudspeaker modules is continuously decreased, an effective method for decreasing the F0 is to select a vibrating diaphragm of a large compliance. However, the vibrating diaphragm of a large compliance may be easily crimped, and the assembling is difficult. In order to reduce the difficulty in assembling of the vibrating diaphragm of a large compliance, a person skilled in the art will bond an annular metal ring as the supporting member at the edge portion of the vibrating diaphragm to prevent the vibrating diaphragm from being crimped. Although the annular supporting member effectively prevents the vibrating diaphragm from being crimped and reduces the difficulty in assembling, it occupies part of the space of the rear voice cavity, and the effective volume of the rear voice cavity is reduced. As a result, the F0 of the loudspeaker module increases and the acoustic performance of the loudspeaker module is degraded.

SUMMARY

The technical problem to be solved by the present disclosure is to provide a loudspeaker module which has a rear voice cavity of larger volume, low F0, wide frequency band, and good acoustic performance without increasing the difficulty in assembling.

In order to solve the above technical problem, the technical solutions of the present disclosure are as follows.

A loudspeaker module, comprising a shell, wherein a vibrating system and a magnetic circuit system are accommodated in the shell, the vibrating system comprises a vibrating diaphragm and a voice coil which are combined together; a whole inner cavity of the module is divided by the vibrating diaphragm into two cavities, i.e. a front voice cavity and a rear voice cavity; and an edge portion of the vibrating diaphragm is fixed on the shell by using an annular supporting member, wherein a plurality of cavity expansion portions formed by incomplete filling are distributed on the supporting member at intervals, and each of the cavity expansion portions is communicated with the rear voice cavity.

As an embodiment, the cavity expansion portions are through holes located at a middle portion of the supporting member and arranged along the supporting member, and the through holes longitudinally penetrate through upper side and lower side of the supporting member.

As another embodiment, the cavity expansion portions are slots located at an edge on at least one side of the supporting member and arranged along the supporting member, the slots longitudinally running through upper and lower sides of the supporting member.

In which, a plurality of brackets for fixing the supporting member are provided at positions on the shell that are corresponding to the lower side of the supporting member at intervals, and gaps for avoiding the cavity expansion portions are formed between each adjacent two of the brackets.

In which, a connection portion is provided between the adjacent two of the brackets, and located at a lower side of an edge on one side of the supporting member that is not provided with the cavity expansion portions.

In which, the supporting member is a rounded rectangle structure, and the cavity expansion portions are provided on four straight edges of the supporting member; and there are four brackets located at lower sides of four corners of the supporting member, respectively.

In which, the shell comprises an upper shell, a middle shell and a lower shell which are orderly combined together, the vibrating diaphragm, the middle shell and the lower shell together define the rear voice cavity, and the brackets and the connection portion are provided on the middle shell.

In which, retaining walls for locating the magnetic circuit system are provided at an edge portion on one side of each of the brackets that is closes to the lower shell, and each of the retaining walls is perpendicular to the brackets and extends towards the lower shell.

In which, the magnetic circuit system comprises a concentrating flux plate; an internal magnet and an internal spring washer are orderly fixed at a middle portion on an inner side of the concentrating flux plate; an external magnet and an external spring washer are orderly fixed at an edge portion on an inner side of the concentrating flux plate; the edge portions of the brackets are connected to an annular locating portion, the annular locating portion surrounds an outer side of the external spring washer, and a lower side of the locating portion overlaps the external magnet.

In which, a mounting hole is provided at a position on the lower shell that is corresponding to the concentrating flux plate, the concentrating flux plate is located at the mounting hole, and an outer surface of the concentrating flux plate flushes with an outer surface of the lower shell; a chamfering plane is provided on an outer side of the lower shell located at an edge position of the mounting hole, and a glue receiving slot is formed between the chamfering plane and the concentrating flux plate.

By using the above technical solutions, the advantageous effects of the present disclosure are as follows.

The vibrating diaphragm of the loudspeaker module of the present disclosure is fixed on the shell through an annular supporting member, a plurality of cavity expansion portions formed by incomplete filling are distributed on the supporting member at intervals, and each of the cavity expansion portions is communicated with the rear voice cavity. Therefore, while ensuring the support function, the providing of the cavity expansion portions effectively reduces the volume of the supporting member and thus the occupied space of the rear voice cavity, increases the effective volume of the rear voice cavity, efficiently decreases the F0 of the module, expands the frequency band of the module, and greatly improves the acoustic performance of the module.

A plurality of brackets for fixing the supporting member are provided at positions on the shell that are corresponding to the lower side of the supporting member at intervals, and gaps for avoiding the cavity expansion portions are formed between each adjacent two of the brackets. Therefore, the brackets provided at intervals do not only increase the volume of the rear voice cavity without affecting the communication between the cavity expansion portion and the rear voice cavity, but also bear the supporting member, increase the bonding strength between the supporting member and the shell, and decrease the difficulty in assembling.

A connection portion is provided between the adjacent two of the brackets, and located at a lower side of an edge on one side of the supporting member that is not provided with the cavity expansion portions. Therefore, the providing of the connection portion further bears the supporting member, which can effectively prevent the supporting member between two brackets from being deformed due to the deformation during the vibration of the vibrating diaphragm, and improve the working stability and the service life of the loudspeaker module.

Retaining walls for locating the magnetic circuit system are provided at an edge portion on one side of each of the brackets that is closes to the lower shell, and each of the retaining walls is perpendicular to the brackets and extends towards the lower shell. Therefore, in the module assembling, the retaining wall can effectively locate the magnetic circuit system in the horizontal direction, thereby efficiently decreasing the difficulty in assembling, increasing the production efficiency and improving the rate of finished products.

The edge portions of the brackets are connected to an annular locating portion, the annular locating portion surrounds an outer side of the external spring washer, and a lower side of the locating portion overlaps the external magnet. Therefore, the locating portion does not only effectively locates the magnetic circuit system in the perpendicular direction, but also expands the contact area between the magnetic circuit system and the shell, increases the bonding strength between the magnetic circuit system and the shell of the module, reduces the difficulty in assembling and prolongs the service life of the module.

In conclusion, the loudspeaker module of the present disclosure solves the technical problem of F0 rising due to the narrow rear voice cavity of the loudspeaker module in the prior art. The rear voice cavity of the loudspeaker module of the present disclosure has larger volume, low F0, wide frequency band, good acoustic performance and long service life, and the assembling process has low difficulty and high production efficiency.

The above descriptions are just summarizations of the technical solutions of the present disclosure, and in order to understand the technical means of the present disclosure more clearly, the specific embodiments of the present disclosure are given as follows.

BRIEF DESCRIPTION OF THE DRAWINGS

The drawings provide further understanding of the present disclosure, constitute a part of the Specification, and explain the present disclosure together with the embodiments of the present disclosure, rather than limiting the present disclosure. In the drawings.

In which, 10: upper shell; 20: middle shell; 22: locating portion; 24: the brackets; 240: gaps; 242: retaining wall; 244: connection portions; 30: lower shell; 32: chamfering plane; 40: dome; 42: vibrating diaphragm; 44: voice coil; 50: supporting member; 52: cavity expansion portions; 60: concentrating flux plate; 62: internal magnet; 64: external magnet; 66: internal spring washer; 68: external spring washer; 70: front voice cavity; 72: sound uttering hole; 74: rear voice cavity.

DETAILED DESCRIPTION

In order to make the objects, the technical solutions and the advantages of the present disclosure clearer, the present disclosure is further illustrated in conjunction with the drawings and the embodiments.

The orientation "upper" that is involved in the description refers to the direction of the vibrating system of the loudspeaker unit, and the orientation "lower" refers to the direction of the magnetic circuit system of the loudspeaker unit. The "inner side" that is involved in the description refers to the side that is closer to the center of the magnetic circuit system, and the "outer side" refers to the side that is far away from the center of the magnetic circuit system.

The First Embodiment

Figure 1:
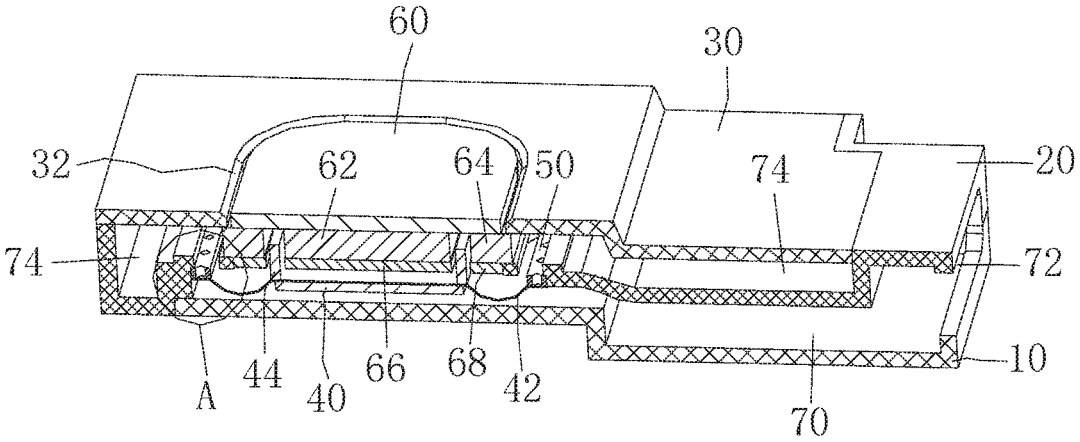
FIG. 1 is a sectional structure diagram of a loudspeaker module of the present disclosure.

As illustrated by FIG. 1, a loudspeaker module comprises a shell composed of an upper shell 10, a middle shell 20 and a lower shell 30 orderly combined together, wherein the space surrounded by the upper shell 10, the middle shell 20 and the lower shell 30 accommodates a vibrating system and a magnetic circuit system therein. The whole inner cavity of the module is divided by the vibrating diaphragm into two cavities, i.e. a front voice cavity 70 and a rear voice cavity 74, wherein the front voice cavity 70 is surrounded by the vibrating system, the upper shell 10 and the middle shell 20, and the rear voice cavity 74 is surrounded by the vibrating system, the middle shell 20 and the lower shell 30. The module is a laterally uttering module, wherein a sound uttering hole 72 is provided at the end of the module that is far away from the vibrating system and the magnetic circuit system, and surrounded by the upper shell 10 and the middle shell 20 together.

As illustrated by FIG. 1, the vibrating system comprises a vibrating diaphragm 42 fixed on the middle shell 20 by an annular supporting member 50, a dome 40 is fixed at a central position of the side of the vibrating diaphragm 42 that is within the front voice cavity 70, a voice coil 44 is fixed on the side of the vibrating diaphragm 42 that is within the rear voice cavity 74, and the supporting member 50 is fixed on the side of the vibrating diaphragm 42 that is within the rear voice cavity 74. The magnetic circuit system comprises a concentrating flux plate 60 fixed on the lower shell 30, an internal magnet 62 and an internal spring washer 66 are orderly fixed at the central positions on the inner side of the concentrating flux plate 60, an external magnet 64 and an external spring washer 68 are orderly fixed at the edge positions on the inner side of the concentrating flux plate 60, and the external magnet 64 and the external spring washer 68 are provided around the outer peripheries of the internal magnet 62 and the internal spring washer 66. The internal magnet 62 and the internal spring washer 66 constitute the internal magnetic circuit of the magnetic circuit system, the external magnet 64 and the external spring washer 68 constitute the external magnetic circuit of the magnetic circuit system, a magnetic gap is provided between the internal magnetic circuit and the external magnetic circuit, and an end portion of the voice coil 44 is located in the magnetic gap. The voice coil 44 carries out the motion of cutting magnetic force lines to and fro in the magnetic gap according to the values and directions of electric signals of acoustic waves passing through the winding, and the vibrating diaphragm 42 and the dome 40 vibrate with the motion of the voice coil, and drive air to utter a sound, thereby converting the electric signals of acoustic waves into acoustic signals, which will be transmitted from the sound uttering hole 72.

Figure 4:
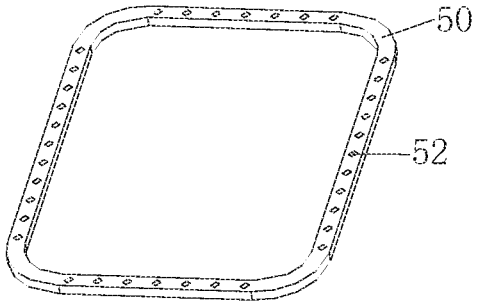
FIG. 4 is a structure diagram of a supporting member of a loudspeaker module of the present disclosure.

As illustrated by FIGS. 1 and 4 jointly, the supporting member 50 is a rounded rectangle structure, and it is a metal ring (e.g., a copper ring, a steel ring, etc.). A plurality of cavity expansion portions 52 are arranged at central positions of four straight edges of the supporting member 50 in the extending directions of each of the straight edges at intervals. The cavity expansion portions 52 are recesses or hole structures formed on the supporting member 50 due to incomplete filling. Each of the cavity expansion portions 52 communicates with the rear voice cavity 74, thereby increasing the volume of the rear voice cavity 74, decreasing the F0 of the module, and improving the acoustic performance of the module.

Figure 3:
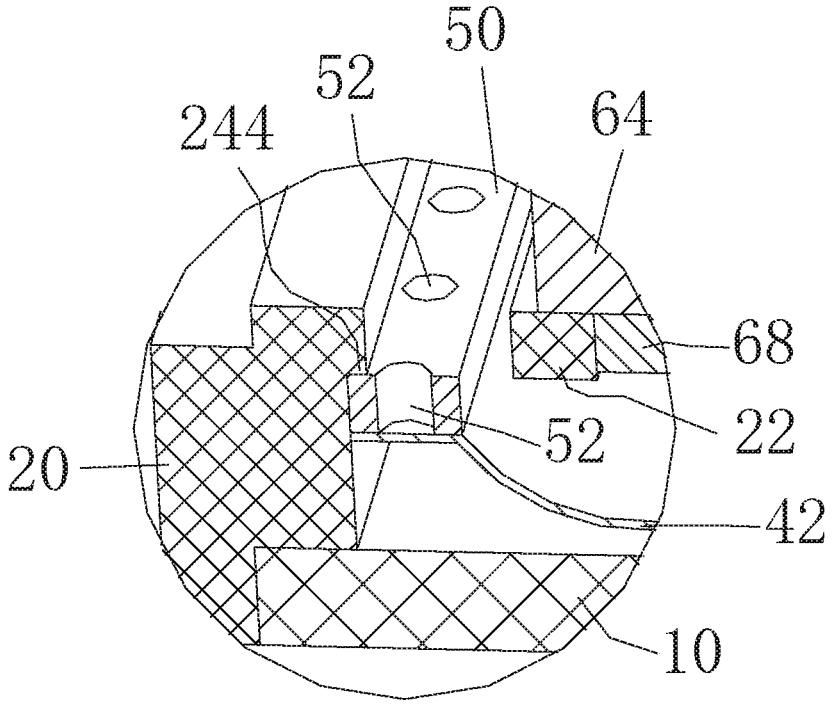
FIG. 3 is an enlarged diagram of the portion A in FIG. 1.

As illustrated by FIGS. 3 and 4 jointly, in this embodiment the cavity expansion portions 52 are preferably circular through holes, which longitudinally run through the upper and lower sides of the supporting member 50. In practical applications, the cavity expansion portions may also be triangle holes, square holes, elongated holes, diamond holes, etc., each realizing the function of expanding the rear voice cavity. In the above holes, the machining of circular holes is the simplest, and a circular through hole forms a cylindrical cavity in the supporting member 50. Of the various columns, the surface of the cylinder is the smallest with the same volume. That is to say, the circular through hole has the smallest damage to the strength of the supporting member 50 with the same volume of the expanded rear voice cavity. Therefore, the cavity expansion portions 52 are preferably circular through holes in this embodiment.

Figure 2:
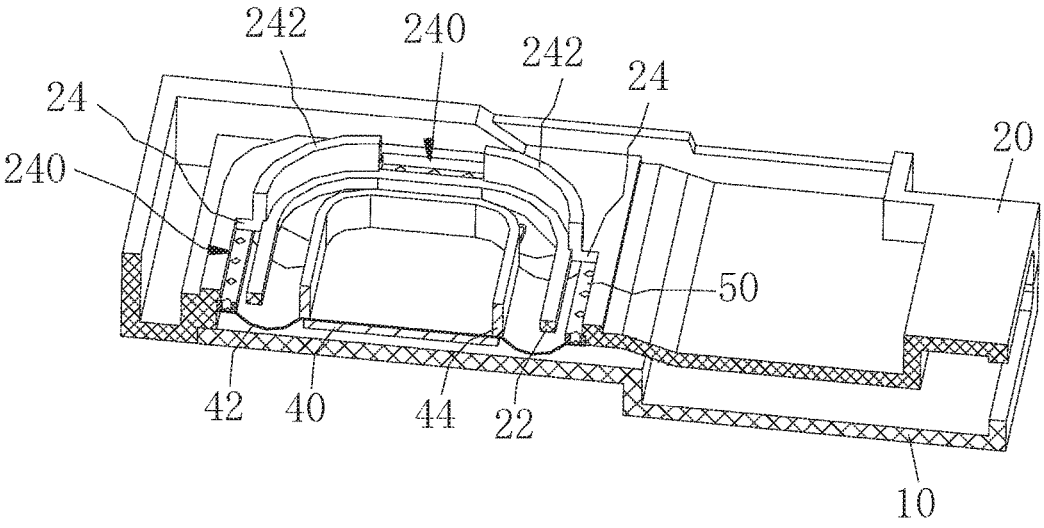
FIG. 2 is a structure diagram of FIG. 1 after a lower shell and a magnetic circuit system are removed.

As illustrated by FIGS. 2 and 3, four brackets 24 are provided at the positions on the middle shell 20 that are corresponding to the lower side of the supporting member 50 at intervals. The four brackets 24 are provided at the positions of the four corners of the supporting member 50 that have no cavity expansion portion 52, respectively, and the brackets 24 have the same arc structure as the corners of the supporting member 50. The lower side of the supporting member 50 is fixed on the upper surfaces of the brackets 24, gaps 240 for avoiding the cavity expansion portions 52 are formed between adjacent two of the brackets 24, and the cavity expansion portions 52 communicate with the rear voice cavity 74 through the gaps 240. The spaces between adjacent two of the brackets 24, i.e., the positions where the gaps 240 are formed, are provided with connection portions 244, which is a strip structure with two ends connected to the brackets 24 on its two sides respectively. In addition, the connection portions 244 are located at the lower side of the outer edge of the supporting member 50, and the widths of the connection portions 244 are less than the minimum distance from the cavity expansion portions 52 to the outer edge of the supporting member 50, i.e., the connection portions 244 avoid the cavity expansion portions 52. The brackets 24 and the connection portions 244 are integrated with the middle shell 20, for the purpose of bearing and fixing the supporting member 50.

As illustrated by FIGS. 2 and 3 jointly, retaining walls 242 for locating the magnetic circuit system are provided at the edge portion on one side of each of the brackets 24 that is close to the lower shell 30. Each of the retaining walls 242 is perpendicular to the lower surface of the brackets 24, and extends towards the lower shell 30. During the module assembling, the retaining walls 242 can locate the magnetic circuit system in the horizontal direction. The edge portions of the brackets 24 are further connected to an annular locating portion 22, which surrounds an outer side of the external spring washer 68. The width of the external spring washer 68 is less than that of the external magnet 64, and the outer edge of the external spring washer 68 is smaller than that of the external magnet 64, so that the outer edge of the external magnet 64 is formed with an annular gap, where the locating portion 22 is located. The lower side of the locating portion 22 overlaps the upper side of the external magnet 64. During the module assembling, the locating portion 22 can locate the magnetic circuit system in the perpendicular direction.

As illustrated by FIG. 1, a mounting hole is provided at the position on the lower shell 30 that is corresponding to the concentrating flux plate 60, with its size and shape adaptive to the concentrating flux plate 60. After the module assembling, the concentrating flux plate 60 is located at the mounting hole, and the outer surface of the concentrating flux plate 60 flushes with the outer surface of the lower shell 30. This structure can minimize the thickness of the module, so that the module meets the requirement on the thinning trend of electronic devices.

As illustrated by FIG. 1, a chamfering plane 32 is provided on the\ outer side of the lower shell 30 located at the edge portion of the mounting hole. The chamfering plane 32 is provided around the outer periphery of the concentrating flux plate 60, and forms an annular glue receiving slot between it and the lateral side of the concentrating flux plate 60. The glue receiving slot increases the amount of glue coated between the lower shell 30 and the concentrating flux plate 60 and the bonding strength between the concentrating flux plate 60 and the lower shell 30, and improves the sealing performance of the rear voice cavity 74.

The Second Embodiment

This embodiment is substantially the same as the first embodiment, and the difference is only as follows.

Figure 5:
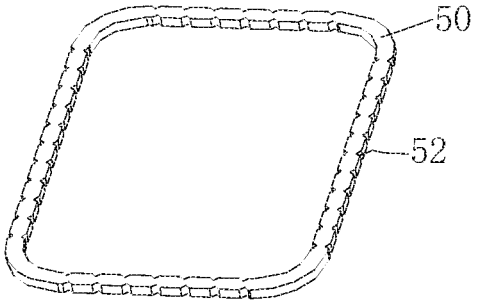
FIG. 5 is another structure diagram of a supporting member of a loudspeaker module of the present disclosure.

As illustrated by FIG. 5, the cavity expansion portions 52 are provided at the edge portions on both sides of the supporting member 50. In practical applications, the cavity expansion portions 52 may also be provided just at the edge portion on one side of the supporting member 50.

The function of expanding the rear voice cavity can also be achieved by providing the cavity expansion portions 52 on the edge portions of the supporting member 50, but compared with the first embodiment, the bonding strength between the supporting member 50 and the middle shell or the vibrating diaphragm in this embodiment is weak. Therefore, the first embodiment is the preferred solution of the present disclosure.

By opening holes in the supporting member, the present disclosure decreases the volume of the supporting member, increases the effective volume of the rear voice cavity, effectively decreases the F0 of the module, expands the frequency band of the module and improves the acoustic performance of the module, while ensuring the strength of the supporting member.

The above embodiments of the present disclosure just exemplarily describe the technical solution of the present disclosure where the cavity expansion portions formed by incomplete filling are provided on the supporting member. In practical applications, the technical solutions of the present disclosure are not limited to the structure of the above module, and can be applied to any module where a supporting member is provided at the edge of the vibrating diaphragm. Therefore, any product in which cavity expansion portions formed by incomplete filling are provided on a supporting member, for the purpose of expanding the rear voice cavity of the module and decreasing the F0 of the module, should fall within the protection scope of the present disclosure, regardless whether the structure of the loudspeaker module is the same as that of the above module, or whether the structure of the supporting member is the same as that of the above supporting member.

The present disclosure is not limited to the above special embodiments. Diverse variations envisaged by a person skilled in the art from the above idea without paying creative work all fall within the protection scope of the present disclosure.

The invention claimed is:

1. A loudspeaker module, comprising a shell, wherein a vibrating system and a magnetic circuit system are accommodated in the shell, the vibrating system comprises a vibrating diaphragm and a voice coil which are combined together;

a whole inner cavity of the module is divided by the vibrating diaphragm into two cavities, i.e. a front voice cavity and a rear voice cavity; and an edge portion of the vibrating diaphragm is fixed on the shell by using an annular supporting member, wherein a plurality of cavity expansion portions formed by incomplete filling are distributed on the supporting member at intervals, and each of the cavity expansion portions is communicated with the rear voice cavity; and a plurality of brackets for fixing the supporting member are provided at positions on the shell that are corresponding to the lower side of the supporting member at intervals, and gaps for avoiding the cavity expansion portions are formed between each adjacent two of the brackets.

2. The loudspeaker module according to claim 1, wherein the cavity expansion portions are through holes located at a middle portion of the supporting member and arranged along the supporting member, and the through holes longitudinally penetrate through upper side and lower side of the supporting member.

3. The loudspeaker module according to claim 1, wherein the cavity expansion portions are slots located at an edge on at least one side of the supporting member and arranged along the supporting member, the slots longitudinally running through upper and lower sides of the supporting member.

4. The loudspeaker module according to claim 1, wherein a connection portion is provided between the adjacent two of the brackets, and located at a lower side of an edge on one side of the supporting member that is not provided with the cavity expansion portions.

5. The loudspeaker module according to claim 4, wherein the supporting member is a rounded rectangle structure, and the cavity expansion portions are provided on four straight edges of the supporting member; and there are four brackets located at lower sides of four corners of the supporting member, respectively.

6. The loudspeaker module according to claim 5, wherein the shell comprises an upper shell, a middle shell and a lower shell which are orderly combined together, the vibrating diaphragm, the middle shell and the lower shell together define the rear voice cavity, and the brackets and the connection portion are provided on the middle shell.

7. The loudspeaker module according to claim 6, wherein retaining walls for locating the magnetic circuit system are provided at an edge portion on one side of each of the brackets that is closes to the lower shell, and each of the retaining walls is perpendicular to the brackets and extends towards the lower shell.

8. The loudspeaker module according to claim 7, wherein the magnetic circuit system comprises a concentrating flux plate; an internal magnet and an internal spring washer are orderly fixed at a middle portion on an inner side of the concentrating flux plate; an external magnet and an external spring washer are orderly fixed at an edge portion on an inner side of the concentrating flux plate; the edge portions of the brackets are connected to an annular locating portion, the annular locating portion surrounds an outer side of the external spring washer, and a lower side of the locating portion overlaps the external magnet.

9. The loudspeaker module according to claim 8, wherein a mounting hole is provided at a position on the lower shell that is corresponding to the concentrating flux plate, the concentrating flux plate is located at the mounting hole, and an outer surface of the concentrating flux plate flushes with an outer surface of the lower shell; a chamfering plane is provided on an outer side of the lower shell located at an edge position of the mounting hole, and a glue receiving slot is formed between the chamfering plane and the concentrating flux plate.

* * * * *